United States Patent [19]

Yoshida et al.

[11] Patent Number: 4,879,207

[45] Date of Patent: Nov. 7, 1989

[54] SAFELIGHT FOR SILVER HALIDE LIGHT-SENSITIVE PHOTOGRAPHIC MATERIAL

[75] Inventors: Kazuhiro Yoshida; Yasuhiko Takamuki, both of Hino, Japan

[73] Assignee: Konica Corporation, Tokyo, Japan

[21] Appl. No.: 180,776

[22] Filed: Apr. 12, 1988

[30] Foreign Application Priority Data

| | | | |
|---|---|---|---|
| Apr. 14, 1987 | [JP] | Japan | 62-92843 |
| Apr. 14, 1987 | [JP] | Japan | 62-92844 |
| May 28, 1987 | [JP] | Japan | 62-132753 |
| Oct. 28, 1987 | [JP] | Japan | 62-274391 |

[51] Int. Cl.[4] ..... G03C 1/04

[52] U.S. Cl. ..... 430/564; 430/21; 430/139; 430/495

[58] Field of Search ..... 430/139, 564, 21, 495

[56] References Cited

U.S. PATENT DOCUMENTS

| | | | |
|---|---|---|---|
| 2,672,416 | 3/1954 | Stanton | 430/139 |
| 3,936,173 | 2/1976 | Kidd et al. | 430/31 |
| 4,028,105 | 6/1977 | Ono et al. | 430/396 |
| 4,229,095 | 10/1980 | Mir | 430/42 |
| 4,365,018 | 12/1982 | Crutchfield et al. | 430/139 |
| 4,543,308 | 9/1985 | Schumann et al. | 430/139 |
| 4,600,292 | 7/1986 | Fujimaki et al. | 430/53 |
| 4,794,421 | 12/1988 | Stoudt et al. | 430/42 |

FOREIGN PATENT DOCUMENTS

| | | |
|---|---|---|
| 1159632 | 7/1986 | Japan . |
| 3014142 | 1/1988 | Japan . |

*Primary Examiner*—Paul R. Michl
*Assistant Examiner*—Hoa V. Le
*Attorney, Agent, or Firm*—Jordan B. Bierman

[57] ABSTRACT

A safelight for use in handling a silver halide photographic light-sensitive material and a process for manufacturing a silver halide photographic light-sensitive material using the safelight. The safelight has an electroluminescence element as a light source and an effect to lower the fog formation tendency of the photographic material. And a silver halide photographic light-sensitive material manufactured in the safelight is improved on the allowable handling time in safelight.

2 Claims, 11 Drawing Sheets

SAFELIGHT FOR SILVER HALIDE LIGHT-SENSITIVE PHOTOGRAPHIC MATERIAL

FIELD OF THE INVENTION

The present invention relates to a safelight for silver halide light-sensitive photographic materials, the handling of silver halide light-sensitive photographic materials in the safelight, and a method for preparing a silver halide light-sensitive photographic material in the safelight.

BACKGROUND OF THE INVENTION

In the manufacturing process of a silver halide light-sensitive photographic material (hereinafter may be merely called 'light-sensitive material'), various process operations such as the crystal growth, ripening and coating of silver halide emulsions, slitting and cross-cutting and packaging of the coated film, and the like, are performed in a light emitted through a safelight filter which, in order to prevent the light-sensitive material from being fogged, is designed so as to reduce or intercept the light in wavelength regions to which the light-sensitive material is sensitive. The safelight is essentially required to be visually bright and to hardly fog light-sensitive materials. Both the requirements, however, are incompatible with each other, and where a light-sensitive material is handled in a conventional safelight, a gradual increase in the fog of the light-sensitive material is inevitable; even when no fog seemingly appears because of a slight amount of safelight illumination, in fact the fog potentially increases, and if the exposure of the light-sensitive material to the safelight is still further continued, then the fog will radically increase.

The safelight device, which has conventionally been used in handling light-sensitive materials, is called a 'lamp house' (the safelight device is hereinafter referred to as 'lamp house'), is of a construction as shown in, e.g. FIG. 5, composed of a metallic front cover 1 for fixing a safelight glass plate, a safelight glass plate 2, a metallic rear cover 3 having a reflection effect, and an incandescent lamp 4 as a light source.

Such a conventional lamp house which uses an incandescent lamp 4 as a light source is considered undesirable for practical use because if a large wattage-having incandescent lamp is used in trying to make the lamp house brighter, its generation of heat is so large that the lamp house itself becomes highly heated. Also, the conventional lap house is designed so that the light from incandescent lamp 4 is cut by safelight glass 2 into appropriate wavelength regions to which the light-sensitive material is not sensitive. The safelight glass, however, is not enough for the cutting, resulting in the shortening of the safety time of handling the light-sensitive material; this problem is more significant particularly in the case of an infrared light-sensitive material because the safelight glass 2 is unable to sufficiently cut infrared rays. In addition, in order to make the incandescent lamp 4 as a point source of light into the form of a plane, flat light, a certain spatial distance is required between the lamp and the safelight glass 2; that is, the light h as shown in FIG. 4 becomes large. Accordingly, the lamp house becomes so bulky that its installation is restricted in respect of space saving. For this reason, it is difficult for the lamp house to illuminate a limited area or to be installed in a narrow space and also to effectively illuminate only a desired area, so that the whole operation area cannot but be illuminated by the safelight, leading to the exposure of a light-sensitive material in manufacture to the safelight.

A light-sensitive material in the form of a finished product, in the stage of being practically used, is usually unpacked in a darkroom and handled again in safelight for the sake of various operations. The handling in safelight has a possibility of fogging a light-sensitive material. This is caused not only by the characteristics of the safelight used but also by the proneness of the light-sensitive material itself to be fogged. Namely, a light-sensitive material that has been exposed for a long period of time or strongly to safelight, after its completion, is prone to be fogged by the illumination of safelight in the stage of being practically used, raising a problem that shortening the allowable light-sensitive material handling time in the safelight is inevitable.

Such the problem, because the conventional safelight glass with an incandescent lamp is not enough to intercept infrared rays having a wavelength region of above 700 nanometer, is significant particularly in the case of a silver halide light-sensitive material sensitized to infrared rays. From the practical use point of view, while it goes without saying that the safelight for darkroom use should be not only visually bright but hardly fog light-sensitive materials, it is also desirable that the light-sensitive material to be used be one that permits the allowable illuminating time of the safelight in its manufacturing process to be as much long as possible.

SUMMARY OF THE INVENTION

It is an object of the present invention to provide a novel safelight for use in handling silver halide light-sensitive materials.

It is another object of the present invention to provide a method for preparing a silver halide light-sensitive photographic material which is so improved that the allowable safelight illuminating time in the manufacturing process thereof need not be shortened.

It is a further object of the present invention to provide a method of handling a silver halide light-sensitive photographic material which is hardly fogged by safelight.

The above objects are accomplished by a safelight which uses an electroluminescence element as a light source, a method of producing a silver halide light-sensitive photographic material which takes place in the safelight provided with an electroluminescence element as a light source, and a method of handling a silver halide light-sensitive photographic material in the safelight provided with an electroluminescence element as a light source.

DETAILED DESCRIPTION OF THE INVENTION

The electroluminescence element is a light source in itself and can be used as a plane light source. It is as thin as several millimeters to several centimeters thick and its area (shape) can be freely processed into any desired size and form, so that it may be installed in any necessary or narrow place and, when used as a safelight, can illuminate a necessary limited area alone except where the manufacture of a light-sensitive material is making progress. In addition, it emits no infrared rays exceeding 700 nm, so that it can be suitably used as a safelight for silver halide light-sensitive photographic materials particularly sensitized to infrared rays.

As the electroluminescence element usable in this invention, those as described in SUMIAK IBUK, "Actual Techniques for Application of Electroluminescent Material, Part 1 to Part 3", Function and Material, vol. 7, No. 9, p. 43, No. 10, p. 44, No. 11, p. 44 (1987), may be used.

Figure 3:
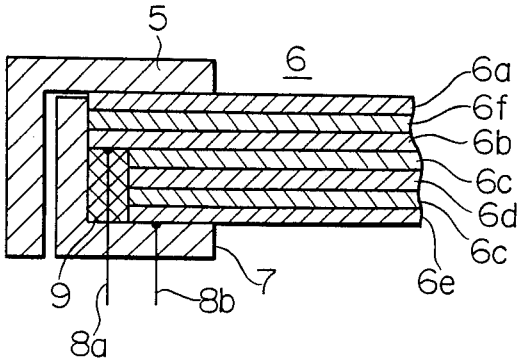
FIG. 3 and FIG. 4 are enlarged sectional end views of other examples of the EL used in this invention.

Those which may be used as the electroluminescence element to be used in this invention are classified as vacuum deposition-type elements and disperse-type elements (enamelled-type, resin-dispersed-type and flexible-type elements). Any of these elements may be used, which are readily commercially available from Nippon Electric Co., Ltd., Elics Corp., and the like. The construction of the electroluminescence element differs somewhat according to those commercially available, but a typical one is, for example, of the construction as shown in FIG. 3, wherein the light-emission layer is comprised of zinc sulfide as a phosphor, doped with a metal or other substance such as Cu, Al, Mn, Cl, etc.

In this invention, the electroluminescence element, although it may be used as a safelight with no filter if it is a selected one having a suitable luminous wavelength, is desirable to be used in combination with a chromatic filter to cut off undesirable wavelength-having rays for a silver halide light-sensitive photographic material.

The above-mentioned chromatic filter is allowed to be separately provided to the electroluminescence element, but may be incorporated into the component layers of the electroluminescence element.

The electroluminescence element may be one selected so as to be of an almost discretional luminous wavelength ranging from blue to red according to its kind, so that it is easy to select its kind, taking into account the wavelength region to which the light-sensitive material is sensitive, the relative luminosity, and the like, and, if necessary, to select a proper filter to be used in combination that can improve the safelight characteristics.

Figure 1:
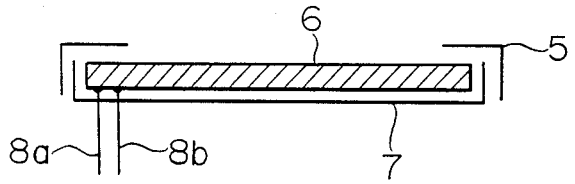
FIG. 1 is a schematic vertical-sectional elevation of a lamp house for light-sensitive material use, which is provided with an electroluminescence element (hereinafter may be abbreviated to EL) according to this invention as a light source.

The present invention will now be illustrated according to the drawings:

FIG. 1 is a drawing showing an example of the construction of a lamp house of this invention, wherein indicated with 5 is a front cover made of plastic or metallic material, 6 is an electroluminescence element EL (hereinafter merely called EL) as a plane light source, 7 is a plastic or metallic rear cover, and 8*a* and 8*b* are lead wires for applying a voltage to EL 6.

The EL 6 to be used herein is of the thick layer disperse type or of the thin layer type, and may or may not be flexible.

Figure 2:
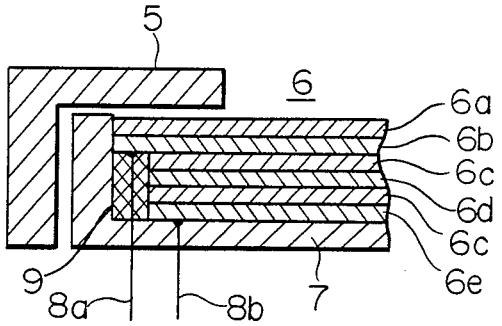
FIG. 2 is an enlarged sectional end view of the one shown in FIG. 1.

FIG. 2 is a partially sectional view of an example of the construction of the EL layer shown by enlarging part of the drawing of FIG. 1, the construction being comprised principally of a plastic or metallic front cover 1 and EL 6.

The construction of EL 6 is comprised in detail of a glass or plastic transparent substrate 6a, a transparent conductive film or grid electrode 6*b* adapted to be able to uniformly apply a voltage to the EL phosphor, a ferrodielectric layer 6*c* such as of barium titanate, yttrium oxide, tantalum oxide, or the like, necessary to apply an electric field to the phosphor, a layer 6*d* comprised principally of zinc sulfide (ZnS) to act as a light-emission layer, doped with manganese (Mn), copper (Cu) or the like, which acts to determine a luminous spectrum, and a metallic substrate 6*e* having a reflective plane provided so as to put the emitted light as much forward as possible.

And it is also provided with a sealing member 9 made of, e.g., epoxy resin, for sealing voltage-applying lead wires 8*a* and 8*b* and electrode 6*b*.

Also, as is shown in FIG. 3, a filter layer 6*f* may be provided between the transparent substrate 6*a* and the doping material-containing layer 6*d* (or on the outside of the transparent substrate 6*a* ) of the layer composition of the plane light source of EL 6 thereby to be made into a more suitable wavelength-having light source (the filter layer may also be provided separately from EL 6).

Figure 4:
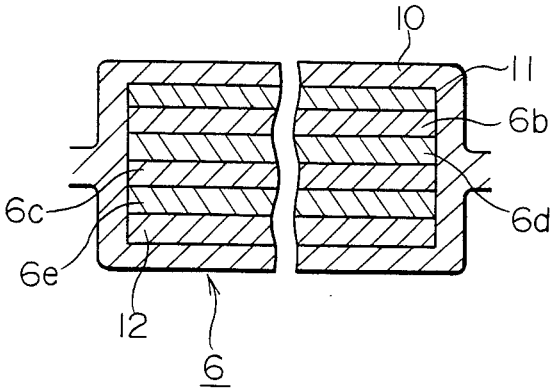
Figure 5:
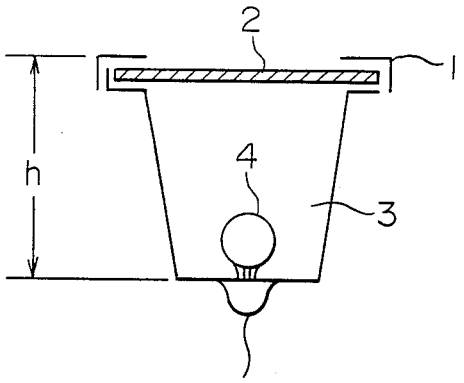
FIG. 5 is a vertical sectional elevation of a conventional ordinary lamp house.

FIG. 4 is a drawing showing a safelight example wherein an electroluminescence element having on both sides thereof water-holding layers 11 and having the external thereof hermetically sealed with waterproof layer 10. In this drawing, lead wires 8*a* and 8*b* are not shown.

Subsequently, electroluminescence element examples suitable for typical silver halide light-sensitive photographic materials and suitable filter examples, if any, to be combined therewith will be given below:

For regular (nonchromatic) light-sensitive materials

EL: Paperlite EL (orange, produced by Elics Co.)

For orthochromatic light sensitive materials

EL: Paperlite EL (orange, produced by Elics Co.)
Filter: SAKURA Safelight Glass No. 8A (produced by Konishiroku Photo Industry Co., Ltd.)

For panchromatic light-sensitive materials

EL: Paperlite EL (green, produced by Elics Co.)
Filter: SAKURA Safelight Glass No. 5D (produced by Konishiroku Photo Industry Co., Ltd.)

For infrared-sensitive photographic materials

EL: Paperlite EL (green, produced by Elics Co.)
Filter: SAKURA Safelight Glass No. 5B (produced by Konishiroku Photo Industry Co., Ltd.)

The safelight which uses the electroluminescence element of this invention as a light source not only less fogs a light-sensitive material than does a conventional safelight whose light is visually equivalent in itself thereto but also its form can be of a thin type, so that, as it is understood from FIG. 1 and FIG. 2, it can be installed so as not directly illuminate the light-sensitive material.

Figure 6:
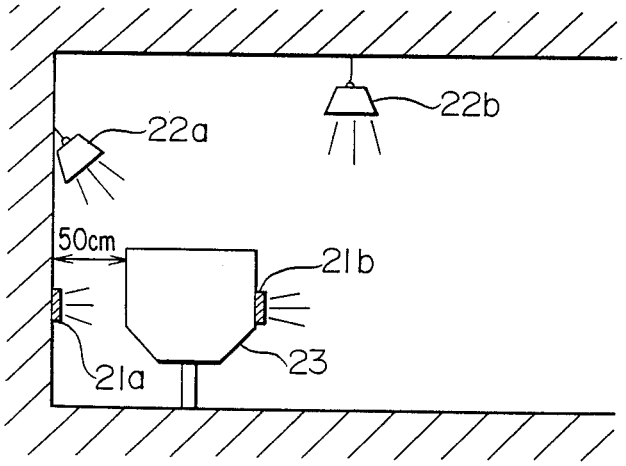
FIG. 6 is a side view of an example of the safelight arrangement inside the silver halide emulsion preparation room according to this invention.
Figure 7:
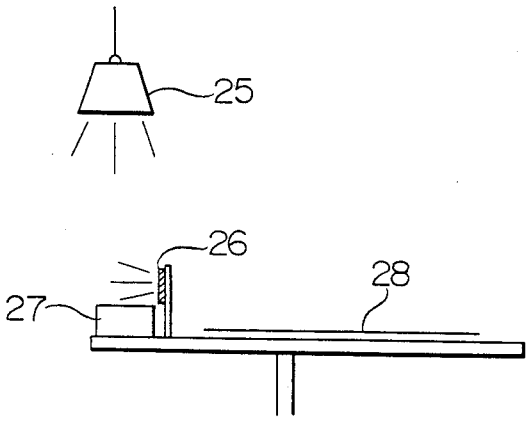
FIG. 7 is a side view of an example of the safelight arrangement above a work bench for handling light-sensitive materials.

FIG. 6 shows a safelight arrangement example wherein the safelight is provided inside a silver halide emulsion preparation room, and FIG. 7 shows an example wherein the safelight is provided above a film-handling table. That is, as is shown in FIG. 6, in the safelight arrangement, a conventional safelight, because of its large size, cannot but be installed as in 22*a* or 22*b*, and cannot be directly installed between the emulsion preparation pot 23 and the wall 24 or provided to the emulsion preparation pot 23, while the safelight of this invention, since it is thin and of a light weight, can be installed anywhere it should be; for example, it may be arranged as shown in 21*a* or 21*b* so as not to directly illuminate an emulsion but to illuminate only an area necessary for other operations.

Also, as is shown in FIG. 7, in the case of installing a safelight so that the numeral of a film counter 27 can be recognized, conventional safelight 25 is to illuminate silver halide light-sensitive photographic material 28, while the safelight of this invention may be installed, e.g., as in 26, so as not to expose silver halide light-sensitive photographic material 28 to the light therefrom.

No particular restrictions are placed on the color sensitivity, photographic speed, etc., of the silver halide light-sensitive photographic material to which the present invention is applicable. This invention can exhibit its effect by being applied to any light-sensitive photographic materials including various color sensitivities-having black-and-white light-sensitive materials such as regular (nonchromatic), orthochromatic, panchromatic and infrared-sensitive photographic materials comprising silver chloride emulsions, silver chlorobromide emulsions, silver chloroiodobromide emulsions, silver iodobromide emulsions, silver iodide emulsions, or the like; multilayer color films (negative-positive process) for subtractive color process use; multilayer color reversal films for subtractive color process use; photographic color papers for making prints from color negatives; and the like.

The light-sensitive material to which this invention is applied may use additives according to purposes.

These additives are described in detail in Research Disclosure (RD), Vol. 176, Item 17643 (Dec. 1978) and Vol. 187, Item 18716 (Nov. 1979). Relevant parts in the publication to these additives will be listed in the following table:

| Additives | RD 17643 | RD 18716 |
|---|---|---|
| Chemical sensitizers | p. 23 | Right col., p. 648 |
| Sensitivity increasing agents | | " |
| Spectral sensitizers | pp. 23–24 | Right col., p. 648 |
| Supersensitizers | | to right col., p. 649 |
| Brightenin agents | p. 24 | |
| Antifoggants and stabilizers | pp. 24–25 | Right col., p. 649 |
| Ultraviolet absorbing filters, ultraviolet absorbing dyes | pp. 25–26 | Right col., p. 649 to left col., p. 650 |
| Antistain agents | Right col., p. 25 | Left to right col., p. 650 |
| Dye image stabilizers | p. 25 | |
| Hardening agents | p. 26 | Left col., p. 651 |
| Binders | p. 26 | " |
| Plasticizers, lubricants | p. 27 | Right col., p. 650 |
| Coating aids, surface active agents | pp. 26–27 | " |
| Antistatic agents | p. 27 | " |

The safelight which uses the electroluminescence element of this invention has the advantage that, despite being visually bright, the element is highly safe for silver halide light-sensitive materials, generates little heat, and can be of a compact type, so that it can be utilized for many uses such as the internal illumination of silver halide light-sensitive material-handling automatic apparatuses such as automatic processors, automatic film feeders, etc., luminous indication for easy access to operating means of various devices provided inside a darkroom, and so forth, in addition to the darkroom safelight use in the manufacture of a light-sensitive material as mentioned earlier. Some of such utilization embodiments will be explained below:

Firstly, an example of the case where the safelight using the EL of this invention as a light source (hereinafter may sometimes be called 'the EL safelight') is installed inside an automatic processor will be explained. A photo-finishing laboratory which is dealing mainly with service requiring darkroom operations for making large-size prints, custom enlargement-ordered prints, color duplications, post card prints, and the like, has darkrooms 33, 33' and 34 provided usually with a film processor 31, sheet paper processor 32 and printer, respectively, and the standard arrangement thereof is as given in FIG. 6, and besides, devices for preparing processing solutions, print data inspection equipment, processor-built-in enlarger, and the like, are additionally arranged.

Figure 9:
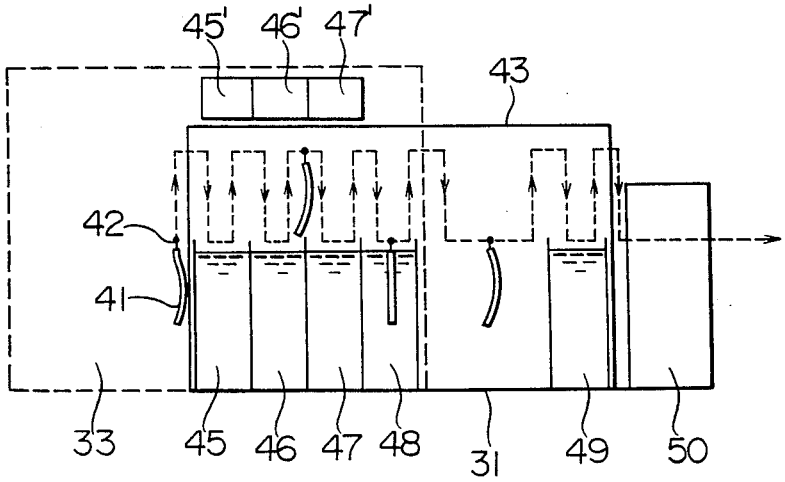
FIG. 9 is a schematic sectional view of an automatic film processor.
Figure 11:
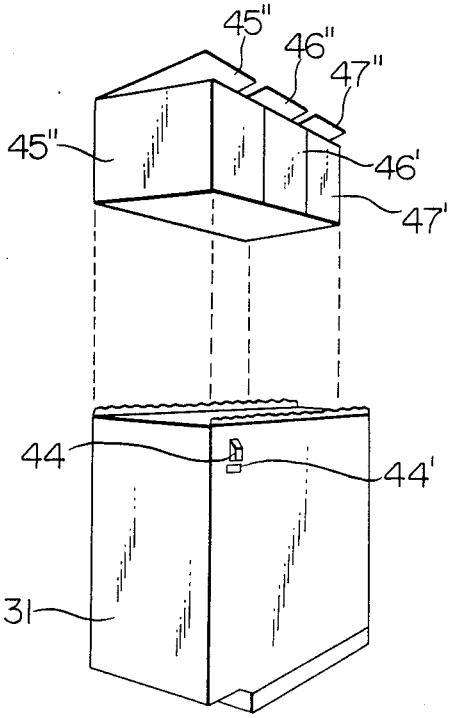
FIG. 11 is a schematic perspective view of the processing liquid baths and replenisher baths viewed from the direction of arrow A in FIG. 1.

The schematic sectional view of automatic film processor 31 shown in FIG. 9 is of a hanger-type automatic film processor which is used generally for processing sheet films. In the automatic processor 31, several sheets of exposed film 41 are set together to each hanger 42, and the film-set hangers 42 are then hung at regular intervals on an elevator 43 that is provided to the foregoing automatic film processor. In starting development, when the start/stop switch 44, in FIG. 11, is turned on, the exposed film 41 set to the hanger 42 is first immersed into a color developer bath 45 by the action of elevator 43, and after a given passage of developing time, when the film set to the hanger is to be transferred into a stop bath 46, the hanger 42 is once lifted above the foregoing color developer bath 45 by the revolution of a chain. Subsequently, the hanger 42 is moved horizontally by the action of elevator 43 to be positioned above the foregoing stop bath 46. By repeating such similar operations as in the above manner, the hanger 42 is then moved in the direction of dotted arrow from the stop bath 46 to a hardener bath 47, then to a washing bath 48, then to a stabilizer bath 49, and then to a dryer 50. That is, sheets of the exposed film hung to each of the hangers 42 are thus processed under specified conditions in the respective processing steps with the hangers 42 being continuously moved.

In each of the processing baths, the processing takes place with the film remaining still and with each solution being stirred by circulation. Therefore, a difference in the degree of stirring may sometimes occur between the upper part and the lower part of each processing bath. Further, according to the position of pouring a replenisher into each bath, a slight change in the processed results can occur between the upper and lower parts of each bath, thus affecting the resulting image density. For this reason, in order to perform a uniform development, gas stirring or vibration agitation is used in combination.

Figure 10:
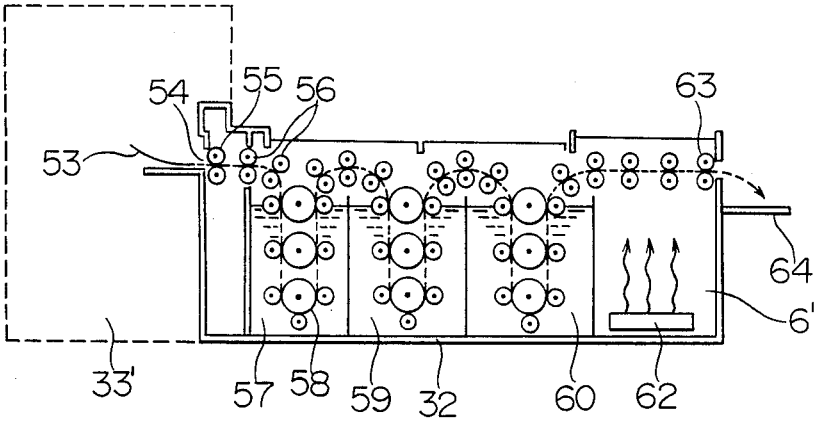
FIG. 10 is a schematic sectional view of an automatic sheet paper processor.

The schematic sectional view of the sheet paper automatic processor 32 shown in FIG. 10 is of a processor generally called a roller transport-type processor. That is, the sheet paper automatic processor 32 has many feed rollers, and by the many feed rollers, exposed sheet paper 53 is driven to be transported in the direction of dotted line, whereby the respective processing steps take place. In addition, the sheet paper automatic processor 33 is also capable of processing roll paper. In order to process the exposed sheet paper 53 in the automatic processor 32, the exposed sheet paper 53 is first inserted into the feed inlet 54 of the sheet paper automatic processor 32 installed inside a darkroom 31'. The foregoing exposed sheet paper 53 is transported by a pair of juxtaposed revolving insertion rollers 55 and a pair of juxtaposed revolving feed rollers 56 to a color developer bath 57, and then, in association with the revolution of the many feed rollers 56 and 58, immersed in the foregoing color developer bath 57 for a given period of time. Further, by the revolution of each pair of rollers similar to the above rollers, the sheet paper is then transported to a bleach-fix bath 59, then to a washing bath 60, and finally to a dryer 61 to be dried, and after that, it is ejected from an ejection roller 63 to a receiving tray 64.

The above-mentioned processing of photographic color paper, for rapid processing, is a two-bath processing method using no red prussiate. This is intended for making in a very short period of time the most important steps of the color developing process for color light-sensitive materials; that is, a positive silver and positive dye image is formed in the foregoing color developer bath 57, and then the developing of the image is short-stopped and the silver and silver halide are dissolved in the foregoing bleach-fix bath 59, thereby making the dye color positive image remain on the paper.

The foregoing automatic film processor 31 and the above-mentioned sheet paper automatic processor still have inconvenient points in the operation thereof. For example, the film processor 31, as is shown in FIG. 9, has above the respective processing baths a color developer replenisher bath 45', stop solution replenisher bath 46' and hardener replenisher bath 47', respectively, so that the respective replenishings can be made according to the degree of exhaustion of each bath caused by the oxidation and evaporation thereof and by the film processing. The above color developer replenisher bath 45', stop solution replenisher bath 46', and hardener replenisher bath 47' need to be replenished regularly by a color developer replenisher solution, stop solution replenisher solution and hardener replenisher solution, respectively. At the time of the replenishing, the above color developer replenisher solution, stop solution replenisher solution and harner replenisher solution prepared in preparation devices have to be supplied by pressure pumps or the like into the respective replenisher baths, but, because these replenisher baths are generally provided above the automatic processor, the illumination from the ceiling safelight alone cannot give brightness enough for darkroom work.

Figure 8:
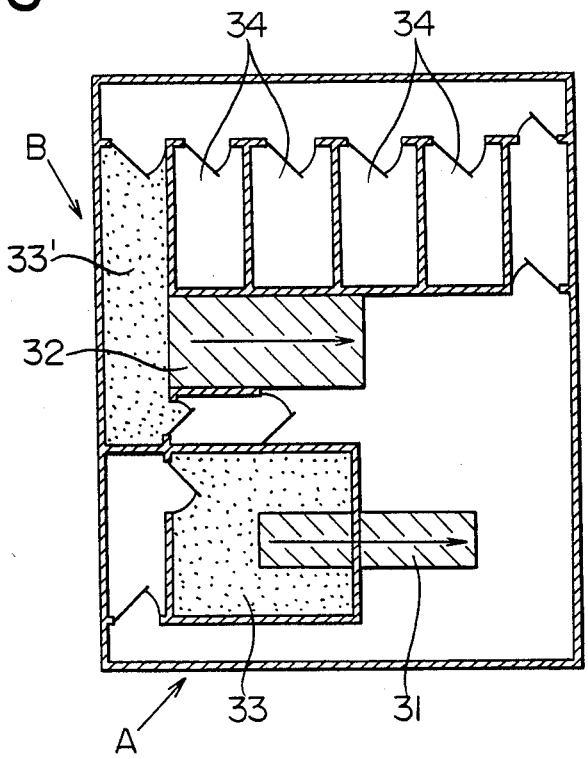
FIG. 8 is a schematic plan view of a film processing laboratory.

Further, while a darkroom operator is doing film processing, there are cases where he has to suddenly stop the operation of the automatic film processor 31 for various reasons. In such the case, despite the start/stop switch 41 being in the proximity of the operator, he often cannot easily notice the position of the switch. Furthermore, after the operation in the printing darkroom 34 as shown in FIG. 8, the operator enters the darkroom 33' in order to develop the exposed sheet paper, and stands before the feed inlet 54 of the foregoing sheet paper automatic processor 32 installed inside the darkroom 33', and when he inserts the exposed sheet paper 53 into the feed inlet 54, he fails to make sure of the position and width of the feed inlet 54, and if he inserts the exposed sheet paper at an oblique angle into the feed inlet 54, the exposed sheet paper 53, if it is of a small size, is slipped down out of the revolving feed rollers 56 and 58, or the like, thereby causing a trouble. In addition, the period of time required for recovery operations or the like is also a factor which may adversely affect the whole production capacity of a photo-finishing laboratory. Also, even when the exposed sheet paper is of a large size, developing marks or twist trouble will occur, and in this instance, there is almost no relief measure therefor.

Such problems can be solved by providing the safelight comprising the EL of this invention at least one each to the inside of the cover of the replenisher bath provided above the automatic film processor, in the proximity of the foregoing start/stop switch 44 of the automatic film processor, and on both sides of the feed inlet of the sheet paper automatic processor.

FIG. 11 is a schematic perspective illustration when viewed from the direction of arrow A in FIG. 8. Firstly, a light source 44' plate comprising EL is provided in the proximity of the start/stop switch 44 equipped on the side of the foregoing automatic film processor 31. The power for the light source is supplied from the film processor 31.

Subsequently, a light source 45" board comprising EL is incorporated in the inside of the cover of the color developer replenisher bath 45' provided above the film processor, and then, in like manner, a light source 46" board comprising EL and a light source 47" board comprising EL are incorporated in the inside of the cover of the stop solution replenisher bath 46 and in the inside of the cover of the hardener replenisher bath 47', respectively, thereby requiring no additional light sources for the regular replenishing operation other than the darkroom safelight, resulting in making both hands of the operator free to improve the operation efficiency; this is favorable also from the security point of view. That the operator, wherever he may be inside the darkroom at the time of film development, can visually confirm the position of the start/stop switch by the emission of the EL light source not only makes him feel at ease but also enables him, in case of any trouble, to quickly stop the automatic film processor without inviting such an error that fogs all the film in processing by turning the darkroom light on by mistake, thus being able to minimize the trouble.

Figure 12:
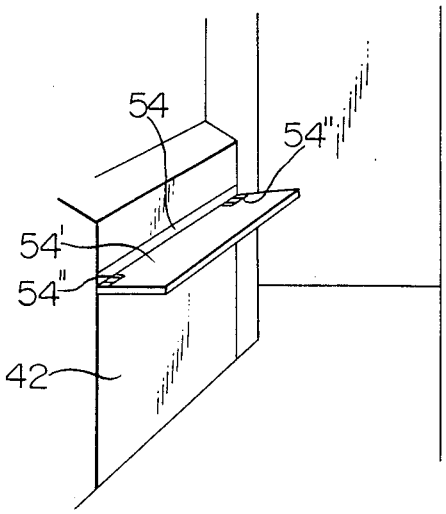
FIG. 12 is a schematic perspective view of the automatic sheet paper processor viewed from the direction of arrow B in FIG. 8.

FIG. 12 is a schematic perspective illustration when viewed from the direction of arrow B in FIG. 1. An EL light source 54" plate is provided on each of both sides of the insertion table 54' at the feed inlet 54 of the sheet paper automatic processor 42 installed inside darkroom 33'. The above EL light source 54" plates are desirable to be as much small as possible, since the supply voltage thereto need only be for visual position confirmation, although there is no need of worrying about fogging if exposed sheet paper 53 is inserted by being placed with its support side down because they are incorporated in the table.

Thus, the operator, who entered the darkroom 33' carrying the exposed sheet paper in his hand, is able to immediately recognize the feed inlet 54 of the sheet paper automatic processor 42, so that such an error as mentioned earlier can never occur.

As has been described, the automatic processor operation and maintenance service operation can be performed rapidly with a high security by the EL light sources arranged as indicators and illuminators in necessary positions for the operations.

Figure 13:
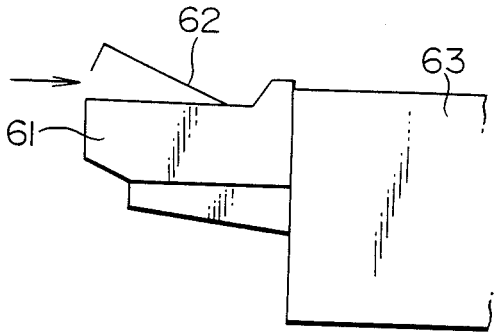
FIG. 13 is a drawing showing the construction of conventional automatic film feeder.

An example of the case where the EL light source of this invention is provided to the automatic film processor will now be explained below:

The automatic film processor utilizes an automatic film feeder for feeding exposed film in order to perform an efficient processing. As is shown in FIG. 13, the automatic film feeder 61 equipped to the automatic processor 63, when loaded thereinto with exposed sheets of film, feeds the sheets of film one by one automatically into the automatic processor 63.

The loading of exposed sheets of film into the automatic film feeder 61 in general has to be done in a darkroom, and this loading operation has been difficult for any ones but skilled operators. For example, in handling monochromatic light-sensitive materials such as medical radiographic films, in order to solve the above problem, a light source having a luminous wavelength region different from the wavelength region to which the light-sensitive material is sensitive, the so-called safelight, has been used, but the light source for such the conventional safelight, in many cases, is provided on the ceiling of a darkroom. However, the safelight provided that way is less effective because it intercepted by the top cover 62 of the automatic film feeder 61 when the cover is lifted open up for loading exposed sheets of film, so that the operator cannot see the film well.

The above-mentioned problem can be solved by a safelight comprising an electroluminescence element as a safelight source, which is provided in the proximity of the film-loading section of the automatic film feeder.

Figure 14:
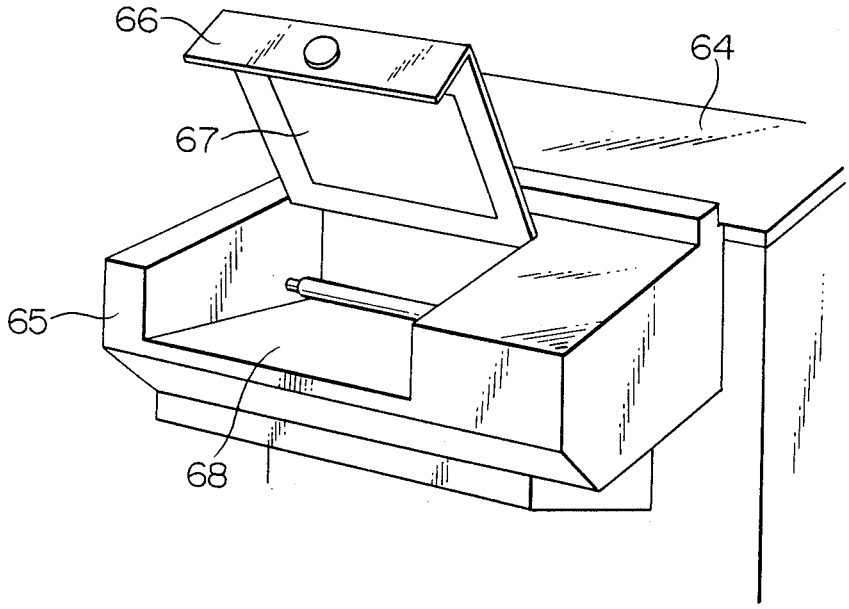
FIG. 14 is a perspective view of an automatic film feeder into which is incorporated a safelight according to this invention.

FIG. 14 is a perspective illustration showing an example of this device, wherein indicated with 65 is an automatic film feeder having the safelight of this invention, which is equipped in a given position of automatic processor 64, and 68 is the exposed sheet film-loading section of the autofeeder, into which specified number of sheets of film can be loaded, 67 is an EL that is made adhere to the reverse side of a cover 66. The luminous color of EL 66 has a luminous wavelength different from the sensitive region of monochromatic light-sensitive materials such as, for example, medical radiographic film, so that it functions as a safelight. Also, the light emission from EL 67 is in association with the open/close operation of top cover 67, and EL 67 lights only when the top cover 66 is open.

The operations in such the construction will then be explained. Firstly, the top cover 66 is opened to load exposed sheets of film into the autofeeder. This operation is performed in a darkroom. Since the EL lights as a safelight, the operator can recognize the film well and can do speedily the film loading operation. After the film loading, just closing the top cover 68 enables sequential automatic feed of the sheets of film in association with the processing ability of automatic processor 64.

In this example, EL 67 is provided on the reverse side of top cover 66, but the position thereof is not limited thereto as long as it is in the proximity of the filmloading section. To take into account the effect of it as a safelight, the embodiment of this example is preferred. The EL 67 may also be provided as a separate member to be at need attached to the automatic film feeder.

This example is shown with respect to the automatic film feeder, but it goes without saying that it can also be utilized for a roll film automatic feeder.

As has been detailed above, the EL safelight-provided automatic film feeder enables the secure and speedy film loading operation, which can be made even by an unskilled operator. Also, the EL safelight, since it is a thin, uniform plane-having light source, requires no special space, so that it is advantageous from the space-saving point of view.

The following example is of the case where the EL safelight is incorporated into an exposed film-winding device to be equipped to the automatic processor, whereby the device is used as a viewer. The X-ray photography that takes place generally for a massive examination is what is called fluorography, which is to convert an X-ray image into a visible fluorescent image to be photographically recorded. The fluorography conducts the fluorescent image recording by reducing the image optically into a small image, and, although not excellent in the depiction in detail of fine diseased parts, is so economical that it is extensively used.

As for X-ray film in the roll form to be sequentially photographable in the foregoing radiography, a large number of rolls of the film can be processed today in a short period of time in the light by an automatic processor capable of processing three or four rolls simultaneously, and the processed rolls of the film are wound around flanges by the automatic winder provided inside the automatic processor. Moreover, in recent apparatus, a viewer, a checking device for visually examining the processed results of finished rolls of film with a light incident upon from the reverse side of film, is provided to the automatic winder, thereby increasing the operation efficiency.

Figure 15:
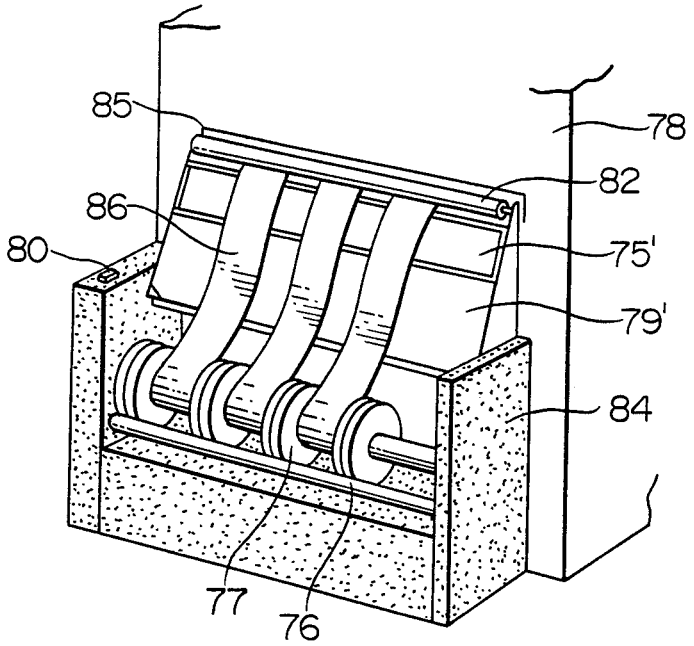
FIG. 15 is a schematic perspective view of a typical example of the conventional-type film winder.

The processing of the X-ray film for use in the conventional fluorography is generally made by an automatic processor having thereinside the aforementioned film winder. Regarding the film winder-incorporated viewer, there are various types thereof, in which the conventional light source for the viewer is restricted by the standard therefor, so that the dimensions and position of the viewer are unable to be freely determined so as to fit in with the film movement. For example, a film winder which has conventionally, generally been used is shown in FIG. 15, wherein 78 is an automatic processor, and the processed film 86 is made close by roller 82 to the viewer 75 comprising a fluorescent lamp as a light source, and then the processed film 86 is wound around flanges 77 which rotates interlockingly in contact with a driving roller 76 by the action thereof, but, as is shown in FIG. 15, in the viewer 75' having a light source With a conventional fluorescent lamp in the linear form, it is hard to make the best use of the light emitted by the viewer because of the crossing relation between the laterally long light source and vertically moving film.

Also, because of the narrow width of the viewer 75', the film area to be examined at a time is limited, requiring more observation effort than is necessary in order to look into the finished results of or marks on processed film. And, to extend the viewer's area, suppose, e.g., the number of fluorescent lamps as the light source is increased, by doing this the viewer 75'-provided board 79' itself would become bulky.

This device is intended for solving the above problem by providing inside the film winder a foldable board-type viewer having at the bottom thereof the EL light source for safelight. In order to utilize the above EL a light source, on a desired board-type plate is provided the EL with its dimensions determined according to the position into which film is moved.

Figure 16:
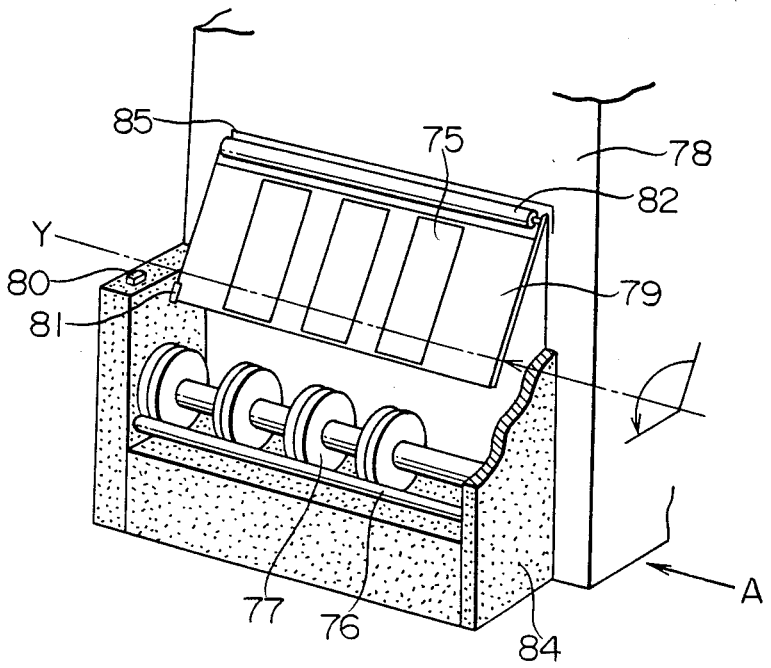
FIG. 16 is a schematic perspective view of an example of the film winder having a viewer comprising a safelight having the EL of this invention as a light source therefor.
Figure 17:
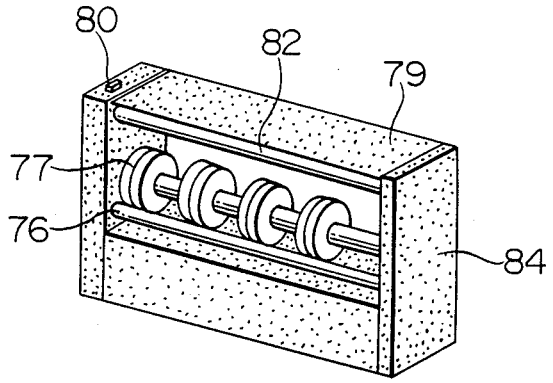
FIG. 17 is a schematic perspective view of the viewer of FIG. 16 in the state of being hidden away.
Figure 18:
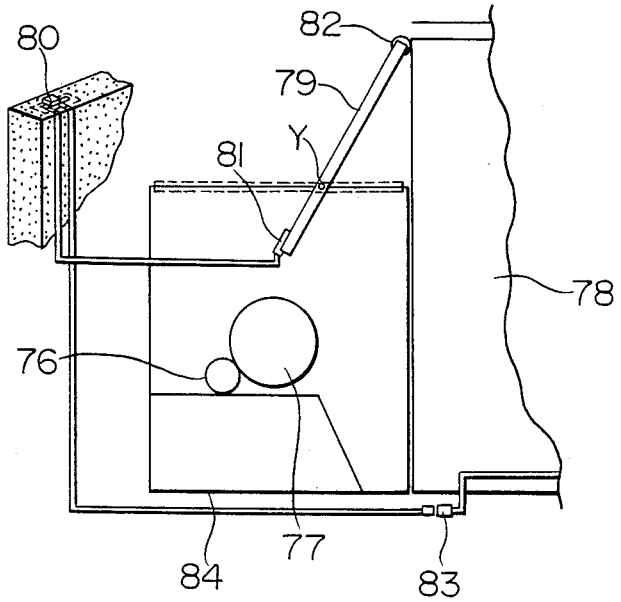
FIG. 18 is a schematic sectional view of an example of the film winder of FIG. 16.
Figure 19:
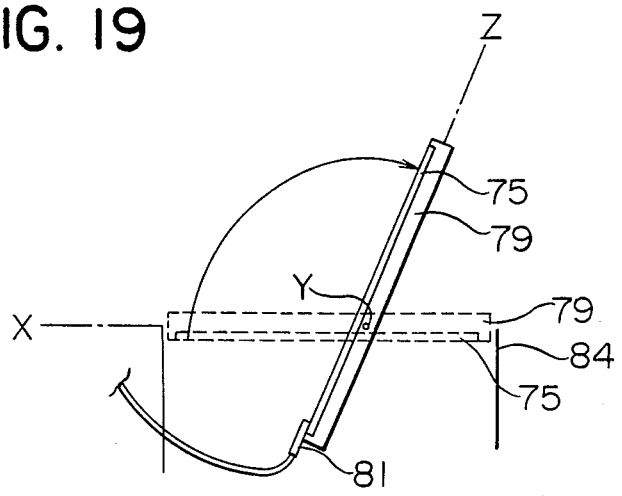
FIG. 19 is a schematic sectional view of the mechanical construction of a viewer which uses the safelight of this invention.

FIG. 16 is a schematic perspective illustration showing an example of this device, wherein 75 is an EL which is incorporated with its dimensions determined according to the film running position in a board 79, 77 is a set of flanges to wind processed film rolls coming out of an outlet 86 of an automatic processor, the flange 77 being interlockingly rotated by the action of the driving roller 76 in contact therewith. FIG. 17 is a schematic perspective illustration showing another example of this device in the case where the board 79 of FIG. 16 is pivoted in the direction of arrow upon the Y axis; i.e. when the EL 75-incorporated board 79 is in the state of being hidden away. And FIG. 18 is a schematic sectional view when viewed from the direction of arrow A of FIG. 16, wherein when switch 80 is turned off, the current [AC 100 V 0.5 A 50/60 Hz] that has been supplied from the automatic processor body by connection plug 83 reaches a connecting switch (not shown) that is provided to stopper 81. And if the EL 75-incorporated board 79, i.e., the viewer serving as the top cover of the film winder, is raised from the X line to the Z line by being pivoted in the direction of arrow as shown in FIG. 19 upon the Y axis, then the top end of the viewer is set to the automatic processor 78 (not shown), and at the same time the bottom end of the viewer comes into contact with the stopper 81 provided inside the body 84. At this moment, the EL foot (not shown) provided to the EL 75 also comes into contact with the connecting switch to supply the current to the EL 75 to let it emit a light, whereby the processed film 86 that has come out of the outlet of the automatic processor 78 (see FIG. 16) and the viewer comprised of the EL 75-incorporated board 79 are arranged in the same direction, thus enabling to make the best use of the light emitted from the viewer. And this also enables to solve the disadvantages that have occurred due to the vertical narrow width of the viewer with the fluorescent lamp as a light source which has been set forth with respect to the prior art.

The device, as has been detailed above, allows the determination of the dimensions and position of the viewer according to the number and size of rolls of film in the stage of designing as a result of providing inside the film winder the foldable board-type viewer having an EL light source incorporated at the bottom thereof where film runs. The use of the EL as the light source for a safelight permits the viewer to be not of a fixed bulky type but of a thin board type, so that it can be of a compact type to be hidden away. Also, during the down time of the automatic processor 78, the viewer becomes the top cover above the film winder and has an effect of serving to protect the film winder from stain, dust, damage, etc. Further, because it is of a simple construction, there is no need to care about any possible damage.

An example of the case where an EL safelight is used in the form of position indicator plates inside a darkroom will now be explained. It will be described in detail by taking a photo-finishing laboratory as an example.

Figure 20:
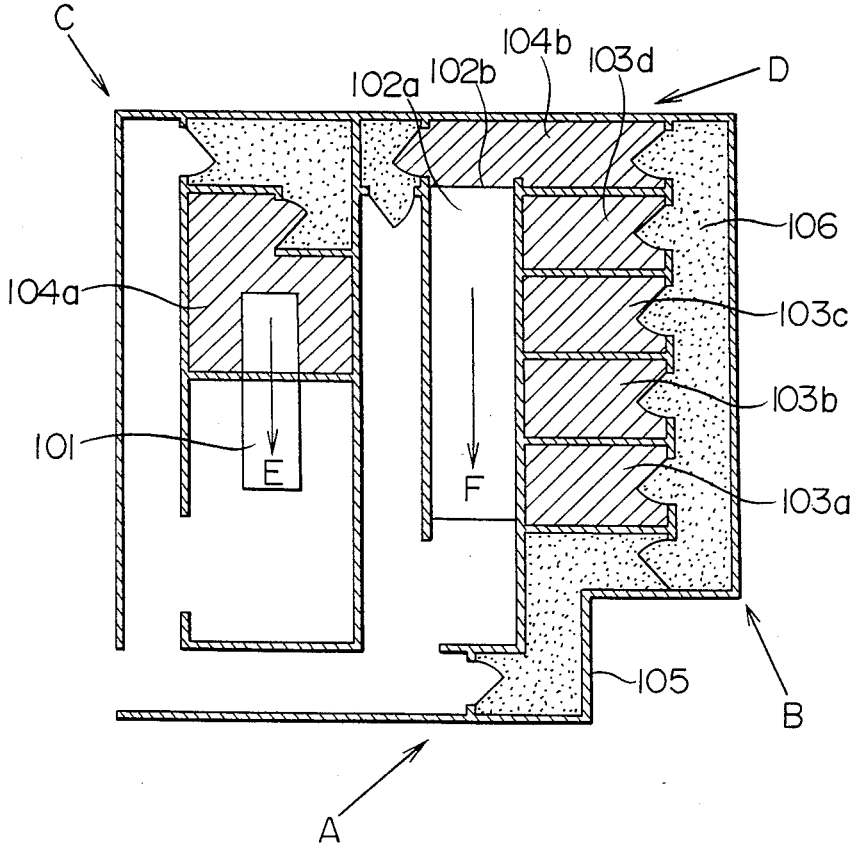
FIG. 20 is a schematic plan view of an example of the photo-finishing laboratory.

FIG. 20 is a schematic plan view of a photo-finishing laboratory. Regarding the layout, i.e., internal equipment arrangement, of a photo-finishing laboratory which is generally called 'lab', although it depends on the type of film to be handled and processed, the method of processing, and quantities of film to be processed, an ordinary lab is cited in the arrangement shown in FIG. 20. In FIG. 20, 101 is a film processor. An exposed roll of film is set to each of hangers in a developing room **104*a*, and the hangers are then hung one by one on the elevator 107 of the processor, and the processing thereof makes progress, moving in the direction of arrow E. Indicated with 102*a* is a paper processor, and rolls of paper exposed through negatives in darkrooms 103*a*, 103*b*, 103*c* and 103*d* are fed into the paper feed section 102*b* in the paper processing room 104*b* shown in FIG. 24**, and then the processing thereof makes progress, moving in the direction of arrow F.

Incidentally, the oblique-lined portions of FIG. 20 are light-intercepted places called darkrooms, while the dotted portions are light-intercepted passages which are designed so as to intercept the light coming from the outside at the time of opening any one of the darkroom doors.

The above-mentioned lab operations are of course comprised mainly of darkroom operations. Therefore, every darkroom operator has to grope for all his work in the dark, so that it is hard for him to make judgement in access to necessary positions at the time of operations at, for example, the passage 105 to the darkrooms, the passage 106 before the divided darkrooms, and the darkrooms each having a space, as shown in FIG. 20.

Even walking and the opening-closing of doors are hard for those unskilled operators in such places as the film-processing room 104*a* and paper processor rooms 103*a*, 103*b*, 103*c* and 103*d*, thus tending to cause erroneous operations.

Such the problem can be solved by providing position-indicator plates comprised of the EL inside the darkrooms.

Figure 21:
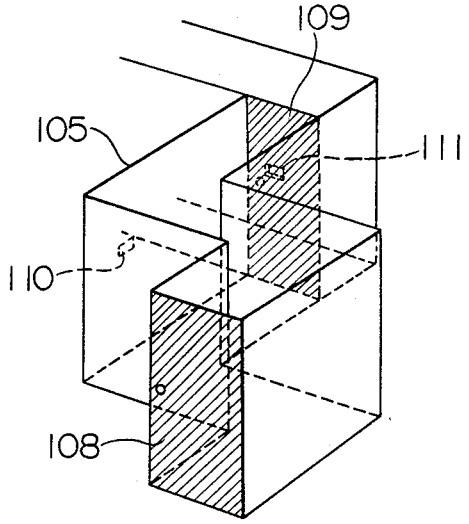
FIG. 21 shows an indicator arrangement example which uses the EL of this invention; a schematic perspective view of the arrangement viewed from the direction of arrow A in FIG. 20.
Figure 25:
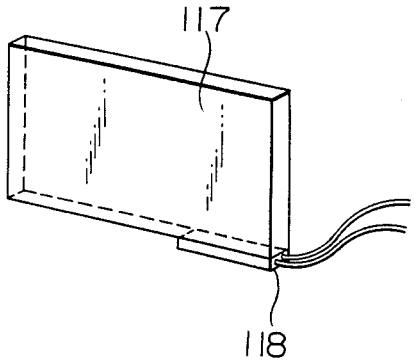
FIG. 25 is a schematic perspective view of an example of the indicator plate comprising an EL element.

FIG. 21 is a schematic perspective illustration of a darkroom construction showing the passage viewed from the direction of arrow A in FIG. 20. The position indicator plates 110 and 111 of this device provided inside the passage 105 are each comprised of EL 117 and a power supply 118 as shown in FIG. 25. The mounting position of the position indicator plate 111 to a second door 109 is preferred to be in the proximity of the door knob. By this, when a printer operator passes the passage 105 to go to the darkroom, even if he shuts the first door 108, he can easily reach the second door 109 according to the guide indication of the position-indicator plates 110 and 111.

Figure 22:
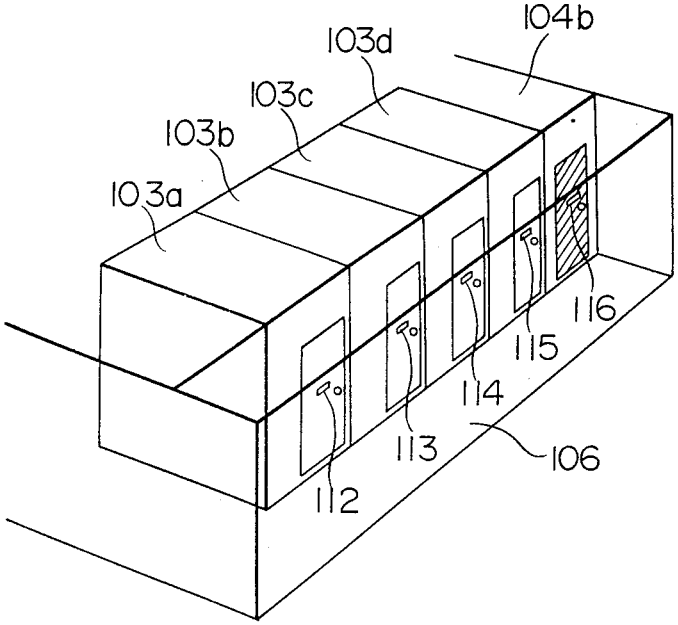
FIG. 22 is a schematic perspective illustration of the arrangement when viewed from the direction of arrow B in FIG. 20.

FIG. 22 is a schematic perspective illustration showing another example wherein such position-indicator plates are provided to show the passage 106, viewed from the direction of arrow B in FIG. 20. Position-indicator plates 112, 113, 114 and 115 are applied to the doors of the darkrooms 103*a*, 103*b*, 103*c* and 103*d*, respectively, and the position-indicator plate 116 is applied to the door of the paper processor room 104*b*. In this instance, the applied position of each position-indicator plate is desirable to be in the proximity of the knob of each door. In addition, it is desirable to be of such a construction that, for example, as is shown in FIG. 26, each position-indicator plate 127 is covered with a plastic plate of the same size, and on the surface of the respective plastic cover plates are indicated appropriate serial position numbers for identification in order of the respective darkrooms.

The position-indicator plates 112, 113, 114 and 115 provided inside the passage 106, as shown in FIG. 25, are each comprised of EL 117 and power supply member 118. By this, when an operator opened the second door 109 and entered the passage 106, he can easily recognize the darkroom he intends to use from the order of the luminous position-indicator plates 112, 113, 114 and 115, thus preventing him from mistakenly opening the door of a darkroom in use, which is not allowed open. Also, by noticing the position-indicator plate 116, an operator can easily reach the paper processing room where post-darkroom operations take place.

Figure 23:
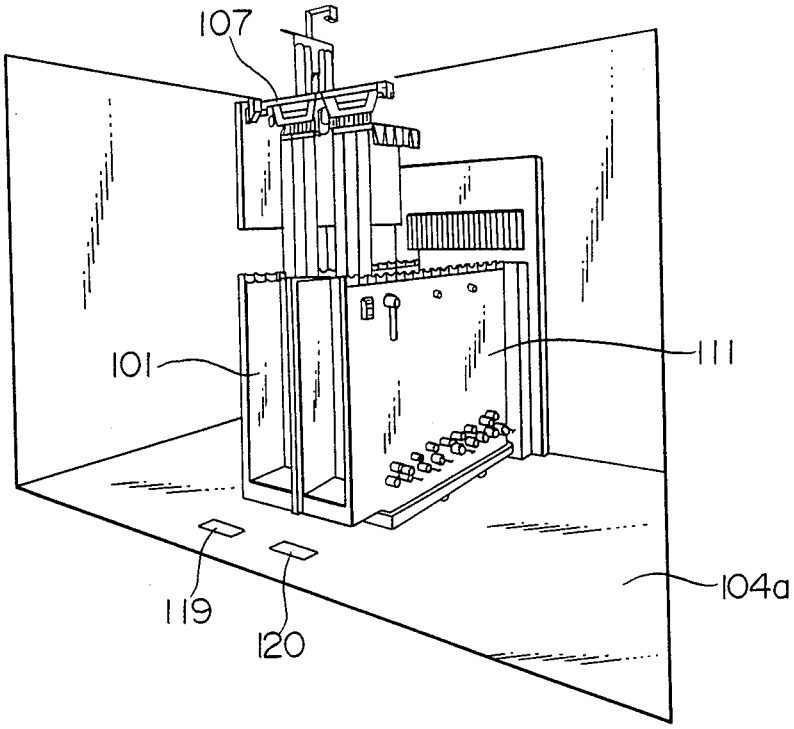
FIG. 23 is a schematic perspective illustration of the arrangement when viewed from the direction of arrow C in FIG. 20.

FIG. 23 is a schematic perspective illustration of another example of the use of position-indicator plates, which shows the application of such plates to the film processing room 104*a* when viewed from the direction of arrow C. The position-indicator plates 119 and 120 in this device provided inside the film processing room 104*a*, as shown in FIG. 25, are each comprised of EL 117 and power supply member 118. To determine the position of the position-indicator plates 119 and 120 relative to that of the film processor 101, the preferred position is at the feet of an operator when he stands with his arms stretched up forward with both hands carrying hangers in the same manner as in actually processing film-set hangers so that the hangers just come into contact with the elevator 107 of the film processor 101.

Also, in this example, since the indicator plates are provided inside the film processing room 104*a*, in order that the unprocessed film taken out of the sheath be not fogged, the supply of power to the position-indicator plates 119 and 120 is desirable to be as much low as possible or the surface of the plates 119 and 120 are desirable to be covered with, e.g., a neutral density filter. Further, since the position-indicator plates 119 and 120 are provided on the floor, they are desirable to have their periphery covered with a strong transparent resin layer, thereby preventing an operator from such an unexpected failure by mistake in hanging hangers on the elevator 107 at the time of development. And the indicator plates also enable operators to notice where the ends of the film processor body are, and thus darkroom operations can be easily made in all their aspects.

Figure 24:
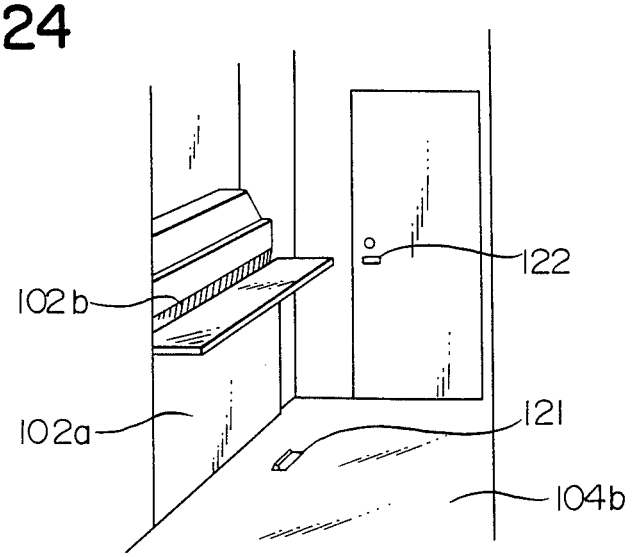
FIG. 24 is a schematic perspective illustration of the arrangement when viewed from the direction of arrow D in FIG. 20.

FIG. 24 is a schematic perspective illustration of an example of the application of such position-indicator plates to the paper processing room when viewed from the direction of arrow D in FIG. 20. The position-indicator plates 121 and 122 of this device are each comprised of EL 117 and power supply member 118 as shown in FIG. 25. The position-indicator plate 121, since it is provided in a position for the operator's feet position indication, is desirable to have its surface covered with a strong transparent resin layer. On the other hand, the position-indicator plate 122, since it may be on a little higher level than that of the paper feed inlet 102*b*, is desirable to be supplied with the lowest possible power so as not to fog unprocessed paper as in the case of the previously mentioned position-indicator plates 119 and 120, or to have its surface combined with, e.g., a neutral density filter, and then covered with a transparent resin layer. By this, a processing operator who has opened the door indicated with the position-indicator plate 116 from the passage 106 side and has entered the paper processing room 104*b* can easily stand before the paper processor according to the position-indicator plate 121 arranged in the floor center position before the processor. After the processor operation, he can easily notice the position of the door by the position-indicator plate 122 in the proximity of the door knob.

As has been described in detail above, the use of such position-indicator plates characterized by comprising the EL light source enables to not only increase the darkroom operation efficiency but also prevent the occurrence of unexpected erroneous operations.

The present invention will be illustrated further in detail by the following examples, but the invention is not limited to and by the examples.

EXAMPLE 1

A cubic-grain silver halide emulsion having an average grain size of 0.26 μm and comprising 62 mole % silver chloride and 38 mole % silver bromide was prepared by the functional addition simultaneous mixing method. The obtained emulsion is a monodisperse-type emulsion, and the quotient of the standard deviation of the grain sizes of the emulsion divided by the average grain size, coefficient of variation, was 15%.

To this silver halide emulsion were added 15 mg per mole of silver of chloroauric acid and 10 mg per mole of silver of sodium thiosulfate, and the emulsion was then chemically ripened for a period of 60 minutes at 60° C. To the emulsion were then further added 6-methyl-4-hydroxy-1,3,3a,7-tetraza-indene as a stabilizer, the following compound A as a sensitizing dye, saponin as a coating aid, ethyl acrylate-methacrylic acid copolymer latex as a softening agent, styrene-maleic acid copolymer as a viscosity-increasing agent, and formalin and sodium 2-hydroxy-4,6-dichloro-1,3,5-s-triazine as hardening agents, and after that, the thus prepared emulsion was coated on a polyethylene terephthalate film base.

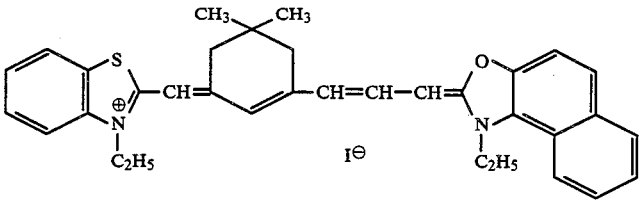

The obtained sample was used to make exposure-to-safelight tests of the following safelights a, b and c by exposing the sample to each one of the safelights arranged at a distance of 1.5 meters from the sample, and then was developed for 20 seconds at 38° C. in the following developer solution. In this instance, these safelights were adjusted by using a diffusion paper so as to be nearly equal in the visual lightness at each subject to be exposed. The results are as given in Table 1.

Safelight a: Green safelight glass (SAKURA Safelight Glass No. B, size: 252 mm × 303 mm, light source: 20 W tungsten bulb.).

Safelight b: Electroluminescence element (green, produced by Elics Co.),size: 252 mm × 303 mm, voltage: 100 V, frequency: 50 Hz.

Safelight c: The above electroluminescence element with Kodak Wratten Filter No. 12.

Developer Solution:

| | |
|---|---|
| Hydroquinone | 25.0 g |
| 4,4-dimethyl-3-pyrazolidone | 0.5 g |
| Potassium sulfite | 100.0 g |
| Potassium bromide | 3.0 g |
| Triethylene glycol | 30.0 g |
| 5-Nitroindazole | 0.1 g |
| Potassium carbonate | 30.0 g |
| Sodium ethylenediaminetetraacetate | 2.0 g |
| 5-Methylbenzotriazole | 0.2 g |

Use sodium hydroxide to adjust the pH to 10.7 and add water to make 1 liter.

TABLE I

| Test No. | Safe-light | Exposure-to-safelight test: Fog produced after 5-min exposure | Fog produced after 15-min exposure |
|---|---|---|---|
| 1 (comparative) | a | 0.10 | 0.50 |
| 2 (invention) | b | 0.04 | 0.08 |
| 3 (invention) | c | 0.04 | 0.06 |

As is apparent from Table 1, in the safelights of this invention, even after the 15-minute exposure of the sample, the increase in the fog of the sample is so slight as to provide allowable time enough for actual film handling, while in the comparative safelight, the increase in the fog is significant.

EXAMPLE 2

A silver iodobromide emulsion having an average grain size of 0.6 μm and containing mole silver iodide was prepared by the ammoniacal simultaneous mixing method, and the emulsion was subjected to gold-sensitization and sulfur sensitization treatment. After that, in the same manner as in Example 1, a sample was prepared from the emulsion. The sample was used in the same exposure-to-safelight tests as in Example 1, and then processed in the following developer solution at 35° C. for 28 seconds. The results are as given in Table 2.

Developer Solution:

| | |
|---|---|
| Anhydrous sodium sulfite | 70.0 g |
| Hydroquinone | 10.0 g |
| Sodium carbonate, monohydrated | 20.0 g |
| 1-Phenyl-3-pyrazolidone | 0.35 g |
| Potassium hydroxide | 0.5 g |
| 5-Methylbenzotriazole | 0.05 g |
| Potassium bromide | 5.0 g |
| Glutaraldehyde hydrogensulfite | 15.0 g |
| Glacial acetic acid | 8.0 g |
| Water to make 1 liter | |

TABLE 2

| Test No. | Safe-light | Exposure-to-safelight test: Fog produced after 5-min exposure | Fog produced after 15-min exposure |
|---|---|---|---|
| 4 (comparative) | a | 0.16 | 0.80 |
| 5 (invention) | b | 0.05 | 0.10 |
| 6 (invention) | c | 0.05 | 0.08 |

As is apparent from Table 2, the safelights of this invention provide allowable time enough for film handing.

EXAMPLE 3

Exposure-to-safelight tests took place in the same manner as in Example 1 except that Compound A, which was used in the preparation of the emulsion in Example 1, was replaced by Compound B, and the safelights that were used in the exposure-to-safelight tests in Example 1 were replaced by the following Safelights d, e and f. The results are as given in Table 3.

Safelight d: Bluish green safelight glass (SAKURA Safelight Glass No. 5C), size: 252 mm×303 mm, light source: 20 W tungsten bulb.

Safelight e: Electroluminescence element (green, produced by Elics Co.), size: 252 mm×303 mm, voltage: 100 V, frequency: 50 Hz.

Safelight f: The above electroluminscence with Kodak Wratten Filter No. 45.

These safelights were adjusted by using a diffusion paper so as to be nearly equal in the visual lightness at each subject to be exposed.

Compound B

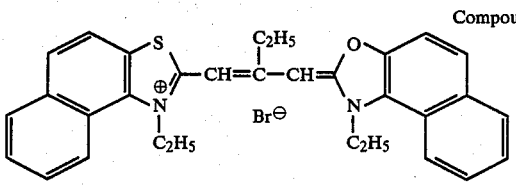

TABLE 3

| Test No. | Safe-light | Exposure-to-safelight test: Fog produced after 5-min exposure | Fog produced after 15-min exposure |
|---|---|---|---|
| 7 (comparative) | d | 0.10 | 0.30 |
| 8 (invention) | e | 0.05 | 0.10 |
| 9 (invention) | f | 0.05 | 0.07 |

As is apparent from Table 3, the allowable sample-handling time in the safelights of this invention is sufficiently long as compared to that in the comparative safelight.

EXAMPLE 4

Two mole silver iodide-containing octahedral silver iodobromide emulsion having an average grain size of 0.7 μm was prepared by the ammoniacal simultaneous mixing method, and the emulsion was subjected to gold sensitization and sulfur sensitization treatment. To this emulsion were then added 6-methyl-4-hydroxy-1,3,3a,7-tetrazaindene and t-butyl-catechol as stabilizers, sodium 2-mercaptobenzimidazolo-5-sulfonate as an antifoggant, and further polyvinylpyrrolidone, trimethylolpropane, nitrophenyl-triphenyl-sulfonium chloride and sodium 1,3-dihydroxybenzene-4-sulfonate as layer's physical characteristics-improving agents, styrene-maleic anhydride copolymer as a viscosity-increasing agent and formalin as a hardening agent, and thus an emulsion coating liquid was prepared.

This emulsion coating liquid was coated uniformly and dried on both sides of a blue-tinted polyethylene terephthalate film base, whereby a sample was obtained. The coated amount of silver was 5 g/m$^2$ in total on both sides.

The obtained sample was used to make exposure-to-safelight tests of the following safelights g and h by exposing the sample to each one of the safelights arranged at a distance of 1.5 meters from the sample, and then developed in the following developer solution by using an automatic processor GX300 (manufactured by Konishiroku Photo Industry Co., Ltd.) for 25 seconds at 35° C., and further fixed and then dried. These safelights were adjusted by using a diffusion paper so as to be nearly equal in the visual lightness at each subject to be exposed. The results are as shown in Table 4.

| | |
|---|---|
| Safelight g: | Orange-color safelight glass (SAKURA Safelight Glass No. 7), size: 252 mm × 303 mm, light source: 20 W tungsten bulb. |
| Safelight h: | Electroluminescence element (orange, produced by Elics Co.), size: 252 mm × 303 mm, voltage: 100 V, frequency: 50 Hz. |

| Developer solution: | |
|---|---|
| Potassium hydroxide | 29.14 g |
| Glacial acetic acid | 10.96 g |

-continued

| Developer solution: | |
|---|---|
| Potassium sulfite | 44.20 g |
| Sodium hydrogencarbonate | 7.50 g |
| Boric acid | 1.00 g |
| Diethylene glycol | 28.96 g |
| Ethylenediaminetetraacetic acid | 1.67 g |
| Hydroquinone | 30.00 g |
| 1-Phenyl-3-pyrazolidone | 1.50 g |
| 5-Nitroindazole | 0.04 g |
| 5-Nitroimidazole | 0.25 g |
| 5-Methylbenzotriazole | 0.03 g |
| Potassium bromide | 5.0 g |
| Glutaraldehyde | 4 93 g |
| Sodium metabisulfite | 12.60 g |
| Potassium bromide | 7.00 g |
| Water to make 1 liter. Adjust the pH to 10.25. | |

As is apparent from Table 4, the allowable film sample-handling time in the safelight of this invention is sufficiently long as compared to that in the comparative safelight.

TABLE 4

| Test No. | Safe-light | Exposure-to-safelight test: Fog produced after 5-min exposure | Fog produced after 15-min exposure |
|---|---|---|---|
| 10 (comparative) | g | 0.08 | 0.16 |
| 11 (invention) | h | 0.06 | 0.08 |

EXAMPLE 5

A sample was prepared in the same manner as in Example 4 except that the following Compounds C and D as sensitizing dyes were added.

Sensitizing Dye C

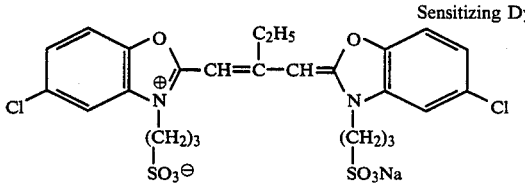

Sensitizing Dye D

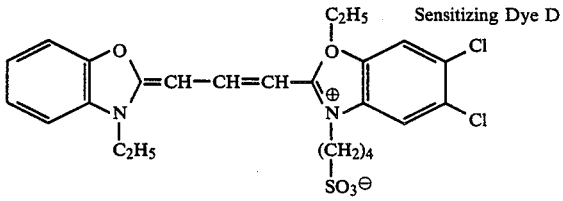

The obtained sample was used to make exposure-to-safelight test of the following safelights i and j by exposing the sample to each one of the safelights arranged at a distance of 1.5 meters from the sample, and then processed in the same manner as in Example 4. The results are as given in Table 5.

Safelight i: Red safelight glass (SAKURA Safelight Glass No. 8A), size: 252 mm×303 mm, Light source: 20 W tungsten bulb.

Safelight j: The safelight h of Example 4 with Kodak Wratten Filter No. 25.

These safelights were adjusted by using a diffusion paper so as to be nearly equal in the lightness at each subject to be exposed.

TABLE 5

| Test No. | Safe-light | Exposure-to-safelight test: Fog produced after 5-min exposure | Fog produced after 15-min exposure |
|---|---|---|---|
| 12 (comparative) | i | 0.08 | 0.14 |
| 13 (invention) | j | 0.06 | 0.08 |

As is apparent from Table 5, the allowable sample-handling time in the safelight of this invention is sufficiently long as compared to that in the comparative safelight.

EXAMPLE 6

In the same manner as in Example 1, an emulsion was prepared and chemically ripened, to which were then added 6-methyl-4-hydroxy-1,3,3a,7-tetrazaindene as a stabilizer, the following Compounds E and F as sensitizing dyes, sodium 2-mercaptobenzimidazolo-5-sulfonate and hydroquinone as antifoggants, sodium p-dodecylbenzenesulfonate as a coating aid, the following Compound G as a hardening agents, butyl acrylateacrylic acid-styrene copolymer as a polymer latex, and styrene-maleic anhydride copolymer as a viscosity-increasing agent, whereby an emulsion layer coating liquid was prepared.

Subsequently, a protective layer coating liquid was prepared by incorporating potassium bromide, the following Compound H as a coating aid, polymethyl acrylate as a matting agent, and formalin and glyoxal as hardening agents into an aqueous gelatin solution.

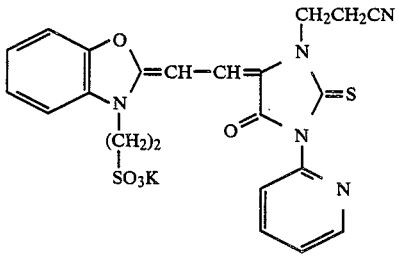

Compound E

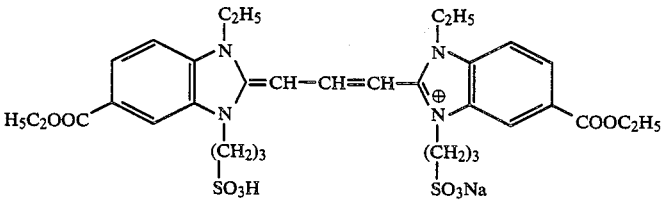

Compound F

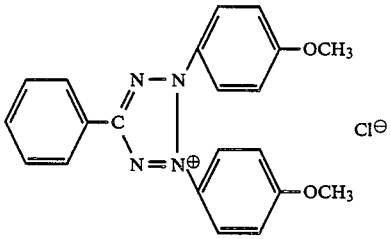

Compound G

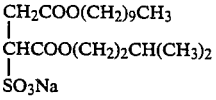

Compound H

The above prepared emulsion layer and protective layer coating liquids were simultaneously superposedly coated on a polyethylene terephthalate support so that the coated amount of silver is 3.5 g/m$^2$.

The obtained sample was contacted with a 150 lines/inch contact screen, and was exposed through an optical wedge to the light from a tungsten light source for a period of 20 seconds, and after that it was used to make exposure-to-safelight tests of the safelights i and j that were used in Example 5, and then developed in the following developer solution by using an automatic processor GR-27 (manufactured by Konishiroku Photo Industry Co., Ltd.) for 30 seconds at 28° C., and further fixed, washed and then dried. The evaluation of the safety of these safelights for the film was made by measuring by what percent the dot area on the film corresponding to the original screen's approximately 50% dot area has increased. The results are as shown in Table 6.

[Developer Solution]

| | |
|---|---|
| Composition A: | |
| Pure water (ion-exchanged water) | 150 ml |
| Disodium ethylenediamine tetraacetate | 2 g |
| Diethylene glycol | 50 g |
| Potassium sulfite (55% w/v aqueous solution) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium hydroxide an amount necessary to adjust the working solution's pH to 10.4 | |
| Potassium bromide | 4.5 g |
| Composition B: | |
| Pure water (ion-exchanged water) | 3 ml |
| Diethylene glycol | 50 g |

-continued

| [Developer Solution] | |
|---|---|
| Disodium ethylenediaminetetraacetate | 25 mg |
| Acetic acid (90% aqueous solution) | 0.3 ml |
| 5-Nitroindazole | 110 ml |
| 1-Phenyl-3-pyrazolidone | 700 mg |

The above Composition A and Composition B were diluted in the described order into 500 ml of water to prepare 1 liter of a working developer solution.

TABLE 6

| Test No. | Safe-light | Exposure-to-safelight test: Dot area after 5-min exposure | Dot area after 15-min exposure |
|---|---|---|---|
| 14 (comparative) | i | 1% | 3% |
| 15 (invention) | j | 0% | 1% |

As is apparent from Table 6, the safelight of this invention, after exposing the film thereto, causes almost no extension of the dot area on the film, thus proving that it provides sufficient allowable time for practical darkroom operations in the safelight, while in the case of the comparative safelight, extension of the dot area is clearly recognized.

EXAMPLE 7

A cubic-grain silver halide emulsion having an average grain size of 0.26 μm and comprising 62 mole % silver chloride and 38 mole % silver bromide was prepared by the functional addition simultaneous mixing method. The obtained emulsion was a monodisperse emulsion, and the coefficient of variation of the grain sizes of this emulsion was 15%.

This emulsion, after adding 15 mg per mole of silver halide of chloroauric acid and 10 mg per mole of silver halide of sodium thiosulfate thereto, was chemically ripened at 60° C. for 60 minutes, and then to the emulsion was further added 6-methyl-4-hydroxy-1,3,3a,7-tetrazaindene as a stabilizer. The obtained emulsion was divided into three parts, which were then separately subjected to the following emulsion preparation treatment at a distance of 1.5 meters from the same safelights a, b and c, respectively, as were used in Example 1, and then coated and dried, whereby Samples No. 1 to 3 were prepared. In this instance, these safelights were adjusted by a diffusion paper so as to be nearly equal in the visual lightness on the surface of these parts of the emulsion at the time of their preparation. Each of these samples was then subjected to exposure-to-safelight tests by being separately exposed to the same respective safelights a, b and c, which were arranged at a distance of 1.5 meters from the sample. These exposed samples were then processed along with the unexposed samples in the same developer solution as was used Example 1 at 38° C. for 20 seconds. The results are as given in Table 7.

Emulsion Preparation

The Compound A as a sensitizing dye that was used in Example 1, saponin as a coating aid, ethyl acrylate-methacrylic acid copolymer latex as a softening agent and styrenemaleic acid copolymer as a viscosity-increasing agent were added, and then formalin and sodium 2-hydroxy-4,6-dichloro-1,3,5-s-triazine as hardening agents Were added to each part of the emulsion, and after that, the emulsion was coated on a polyethylene terephthalate film base.

TABLE 7

| Test No. | Sample | Safelight used: in EM preparation | in exposure test | Fog produced in exposure-to-safelight test: unexposed | 5-min exposed |
|---|---|---|---|---|---|
| 16 | | | a | 0.06 | 1.50 |
| 17 | 1 | a | b | " | 0.15 |
| 18 | | | c | " | 0.08 |
| 19 | | | a | 0.04 | 0.93 |
| 20 | 2 | b | b | " | 0.05 |
| 21 | | | c | " | 0.04 |
| 22 | | | a | 0.04 | 0.90 |
| 23 | 3 | c | b | " | 0.05 |
| 24 | | | c | " | 0.04 |

As is apparent from the above table, Emulsion Sample 16, which was prepared in the non-invention safelight a, shows a very rapid increase in fog when, after its completion, is exposed to the safelight, i.e., its completed sample produces a very high-density fog when exposed for 5 minutes to the safelight a. Even when the safelight b or c for this invention was used for the exposure of the completed sample of Emulsion Sample 1 thereto, its increase in the fog is significant. In contrast, Emulsion Samples 2 and 3, which were prepared in the safelights b and c, respectively, for this invention, show almost no increase in fog even when, after their completion, exposed for 5 minutes to the safelight b or c, and their completed samples' fog is also significantly small even when exposed to the safelight a, so that it is understood that each light-sensitive material prepared in the safelight of this invention is in itself significantly improved on the safelight resistance.

EXAMPLE 8

A silver iodobromide emulsion containing 1 mole % silver iodide and having an average grain size of 0.6 μm was prepared by the ammoniacal simultaneous mixing method. The emulsion was subjected to gold sensitization and sulfur sensitization treatment, and then the same preparation treatment as in Example 7 to thereby obtain Samples 4 to 5. These samples were subjected to exposure-to-safelight tests in the same manner as in Example 7, and then processed along with the unexposed samples in the following developer solution at 35° C. for 28 seconds, which was followed by fixing, washing and drying.

| Developer Solution: | |
|---|---|
| Anhydrous sodium sulfite | 70.0 g |
| Hydroquinone | 10.0 g |
| Sodium carbonate, monohydrated | 20.0 g |
| 1-Phenyl-3-pyrazolidone | 0.35 g |
| Potassium hydroxide | 5.0 g |
| 5-Methylbenzotriazole | 0.05 g |
| Potassium bromide | 5.0 g |
| Glutaraldehyde hydrogensulfite | 15.0 g |
| Glacial acetic acid | 8.0 g |
| Water to make 1 liter | |

The results are as given in Table 8.

TABLE 8

| Test No. | Sample | Safelight used: in EM preparation | in exposure test | Fog produced in exposure-to-safelight test: unexposed | 5-min exposed |
|---|---|---|---|---|---|
| 25 | | | a | 0.08 | 2.72 |
| 26 | 4 | a | b | " | 0.27 |

TABLE 8-continued

| Test No. | Sample | Safelight used in EM preparation | Safelight used in exposure test | Fog produced in exposure-to-safelight test unexposed | Fog produced in exposure-to-safelight test 5-min exposed |
|---|---|---|---|---|---|
| 27 | | | c | " | 0.09 |
| 28 | | | a | 0.04 | 1.70 |
| 29 | 5 | b | b | " | 0.05 |
| 30 | | | c | " | 0.04 |
| 31 | | | a | 0.04 | 1.13 |
| 32 | 6 | c | b | " | 0.05 |
| 33 | | | c | " | 0.04 |

As is apparent from Table 8, Emulsion Samples 4 and 6, which were prepared in the EL safelights b and c, respectively, of this invention, are significantly improved on the safelight resistance as compared to Emulsion Sample 4, which was prepared in the conventional safelight a.

EXAMPLE 9

Emulsion-fog-by-safelight experiments were made in the same manner as in Example 7 except that the emulsion preparation treatment was made under the following four different safelight conditions: Safelights d, e, f and non-safelight, the Compound A for the emulsion preparation was replaced by Compound B, and the aforementioned Safelight d, e and f were used in making exposure-to-safelight tests. In this example, the safelight arrangement at the time of the emulsion preparation treatment is as shown in FIG. 6, and the safelight arrangement at the time of exposure-to-safelight tests is as shown in FIG. 7. The results are as given in Table 9.

Theses safelights were adjusted by using a diffusion paper so as to be nearly equal in the lightness at each subject to be exposed.

TABLE 9

| Test No. | Sample | Safelight used in EM preparation | Safelight used in exposure test | Fog produced in exposure-to-safelight test unexposed | Fog produced in exposure-to-safelight test 15-min exposed |
|---|---|---|---|---|---|
| 34 | | | d | 0.05 | 0.12 |
| 35 | 7 | d | e | " | 0.08 |

TABLE 9-continued

| Test No. | Sample | Safelight used in EM preparation | Safelight used in exposure test | Fog produced in exposure-to-safelight test unexposed | Fog produced in exposure-to-safelight test 15-min exposed |
|---|---|---|---|---|---|
| 36 | | | f | " | 0.07 |
| 37 | | | d | 0.05 | 0.09 |
| 38 | 8 | e | e | " | 0.06 |
| 39 | | | f | " | 0.05 |
| 40 | | | d | 0.05 | 0.08 |
| 41 | 9 | f | e | " | 0.05 |
| 42 | | | f | " | 0.05 |
| 43 | | | d | 0.05 | 0.08 |
| 44 | 10 | none | e | " | 0.05 |
| 45 | | | f | " | 0.05 |

As is apparent from Table 9, as in the case of Examples 7 and 8, the fog produced after 5-minute exposure-to-safelight test on the completed film samples obtained from Emulsion Samples 8 and 9, which were prepared in the safelights of this invention, is on nearly the same level as that of the film sample from Emulsion Sample 10, which was prepared without using any safelight, and they are found to be improved on the safelight resistance as compared to Comparative Emulsion Sample 7.

Also, as seen from this example, the EL safelight of this invention can be freely installed in any desired position, and is very advantageous in respect that it can be used to illuminate locally any necessary spots only for darkroom operations without exposing a silver halide emulsion or completed light-sensitive materials directly thereto.

What is claimed is:

1. A method of handling a silver halide light-sensitive photographic material during at least one step in the manufacturing, using, or processing thereof, said method comprising handling said photographic material under light substantially free from wavelength components to which said photographic material is sensitive, said light being irradiated from a safelight apparatus comprising an electroluminescent element light source, said safelight apparatus comprising a color filter layer positioned further from a light emission layer and a transparent electrode layer of said electroluminescent element.

2. The method of claim 1 wherein said step is a step in the manufacturing process of said photographic material.

* * * * *